US006337539B1

(12) United States Patent
Yorifuji et al.

(10) Patent No.: US 6,337,539 B1
(45) Date of Patent: Jan. 8, 2002

(54) LOW-PRESSURE MERCURY VAPOR DISCHARGE LAMP AND ILLUMINATOR

(75) Inventors: Takashi Yorifuji; Kenji Sugiyama; Toshiyuki Nakamura; Ichiro Yamada, all of Kanagawa-ken (JP)

(73) Assignee: Toshiba Lighting & Technology Corporation, Tokyo (JP)

( * ) Notice: Subject to any disclaimer, the term of this patent is extended or adjusted under 35 U.S.C. 154(b) by 0 days.

(21) Appl. No.: 09/555,267

(22) PCT Filed: Sep. 21, 1999

(86) PCT No.: PCT/JP99/05143

§ 371 Date: May 26, 2000

§ 102(e) Date: May 26, 2000

(87) PCT Pub. No.: WO00/19488

PCT Pub. Date: Apr. 6, 2000

(30) Foreign Application Priority Data

Sep. 29, 1998 (JP) ..... 10-274807
Jul. 23, 1999 (JP) ..... 11-209969

(51) Int. Cl.[7] ..... H01J 13/46

(52) U.S. Cl. ..... 315/56; 315/63; 313/489; 313/483; 313/635

(58) Field of Search ..... 315/56, 58, 50, 315/63; 313/489, 491, 25, 546, 483, 485, 635, 27, 47

(56) References Cited

U.S. PATENT DOCUMENTS 3,898,720 A * 8/1975 Morehead ..... 313/490 X
5,006,755 A * 4/1991 Wittmann et al. ..... 313/546
5,512,798 A * 4/1996 Honda ..... 313/489
5,672,936 A * 9/1997 Hatsutori et al. ..... 313/491
6,057,635 A * 5/2000 Nishimura et al. ..... 313/25

FOREIGN PATENT DOCUMENTS

| | | | |
|---|---|---|---|
| JP | 60-225346 | | 11/1985 |
| JP | 63-80759 | | 5/1988 |
| JP | 63-114039 | | 5/1988 |
| JP | 2-56344 | | 4/1990 |
| JP | 04-192252 | * | 7/1992 |
| JP | 05-121043 | * | 5/1993 |
| JP | 6-5256 | | 1/1994 |
| JP | 06-76797 | | 3/1994 |
| JP | 06-203798 | | 7/1994 |
| JP | 06-267501 | | 9/1994 |
| JP | 07-153422 | * | 6/1995 |
| JP | 08-138623 | * | 5/1996 |
| JP | 09-45281 | | 2/1997 |
| JP | 09-82280 | | 3/1997 |
| JP | 09-213266 | | 8/1997 |

* cited by examiner

*Primary Examiner*—Haissa Philogene
(74) *Attorney, Agent, or Firm*—Pillsbury Winthrop LLP

(57) ABSTRACT

A low-pressure mercury vapor discharge lamp (10$_1$) includes a translucent airtight container (1), a pair of electrodes (2) and (2') mounted in the airtight container (1) and arranged at both ends and so that a distance of one of the electrodes from the sealing portions (1*a*) and (1*a'*) becomes longer than that of the other electrode, a mercury emission body (5) filled in the airtight container and discharge medium including mercury discharged from the mercury emission body (5) and inert gas. A cold spot is formed at one sealing portion (1*a*) of the low-pressure mercury vapor discharge lamp (10) and mercury is filled by the mercury emission body (5) and therefore, there is almost no excess mercury existing in the tube (1), luminous flux starts up fast, mercury collected in the cold spot scarcely moves to other portion, and the lamp characteristic is stabilized.

14 Claims, 9 Drawing Sheets

LOW-PRESSURE MERCURY VAPOR DISCHARGE LAMP AND ILLUMINATOR

This application is the national phase of international application PCT/JP99/05143 filed Sep. 21, 1999 which designated the U.S.

TECHNICAL FIELD

The present invention relates to a low-pressure mercury vapor discharge lamp equipped with a pair of electrodes arranged in different distances from both ends of an airtight container and a lighting system.

BACKGROUND ART

It is known that a low-pressure mercury vapor discharge lamp represented by a fluorescent lamp that lights at the most high efficiency when mercury vapor pressure in the bulb is about 0.8 Pa. The cold spot temperature of the bulb wall at this time is about 40° C.

On the other hand, a lamp that is lighting at a high atmospheric temperature or a lamp that has high inner wall load of the lamp bulb (input power per surface area of the bulb) is used at low efficiency because its temperature at the cold spot temperature of the bulb wall exceeds about 40° C. As a measure to improve efficiency of a lamp lighting at a high temperature of the cold spot, there is a method to fill amalgam, which is an alloy of mercury with other metal, in a bulb and lower mercury vapor pressure to about 0.8 Pa in the high temperature state. This method is adopted principally for compact self ballasted fluorescent lamp, etc.

However, there is such a problem that when amalgam is applied to ordinary fluorescent lamps, mercury vapor pressure drops too low when starting, in particular at a low temperature, and the startup of luminous flux becomes worse. As a measure to solve this problem, a method to improve lighting efficacy by forming a cold spot of a lamp bulb positively, lowering a temperature at one of the ends of the lamp, taking a large distance from one of the electrodes arranged at both ends of a lamp and filling pure mercury as disclosed in, for instance, Published Unexamined Japanese Patent Application No. 267501/1994 is known.

However, it was revealed that according to a method to make a distance from the end of one of the electrodes as before, the lamp characteristic including total luminous flux is not stabilized until mercury is collected to the cold spot that is formed at one of the ends.

Further, even if mercury was collected to the cold spot and the lamp characteristic was stabilized, mercury may move from the cold spot to other portion by a vibration applied to the lamp, etc. and the characteristic may be turned to the unstable state again.

In recent years, fluorescent lamps that are lighted with lighting efficiency above a certain level at a large lighting output in lighting devices that are used at a high ambient temperature are progressively developed, and this problem becomes important more and more as a result of the revision of "Law relative to rationalization of use of energy", in March, 1999.

The present invention was made in view of the above-mentioned problem and it is an object to provide a low-pressure mercury vapor discharge lamp capable of improving the startup of luminous flux and reducing a time until lamp characteristic is stabilized and a lighting equipment.

DISCLOSURE OF INVENTION

A low-pressure mercury vapor discharge lamp comprises a translucent airtight container, a pair of electrodes filled in this airtight container at both ends and so arranged that a distance of one electrode from the end becomes longer than that of the other electrode, a mercury emission body filled in the airtight container, and discharging medium including mercury vapor discharged from the mercury emission body and inert gas.

Further, a translucent airtight container of the low-pressure mercury vapor discharge lamp of the present invention can be any tube provided that it is able to transmit ultraviolet rays or visible rays discharged from a fluorescent membrane formed in the airtight container and separate the discharge from the ambient atmosphere and envelope in the inside, and its material, shape and dimensions are not restricted. Generally, for reasons of environmental adaptability, economy and workability, soda lime glass is used in many cases. Further, for general lighting use, an airtight container in slender and tubular shape is used in many cases.

A hot-cathode equipped with a filament coil is normally used as an electrode. However, cold-cathode, ceramic electrode having electronic radiation material and any other materials are usable in this invention.

The electrodes are arranged at more than certain distance away from the ends supported by lead wires, etc. Lead wires supporting the electrodes may be filled in the container according to such a method as a pinch seal to directly fix the lead wires, etc. in addition to lead wires attached to flare stems or button stems attached to the ends of the container.

The arrangement of a pair of electrodes in different lengths from respective ends means a structure that the lengths between respective ends and the electrodes are made different to form the cold spot between the ends and the electrodes.

Mercury as a discharge medium can be filled in the form of pure mercury or amalgam. The filling method and amount of use can be according to a usual way. Normally, Argon (Ar) is used principally for inert gas. However, Neon (Ne), Krypton (Kr) and Xenon (Xe) can be used independently or in mix. The known range of filling pressure is applicable to inert gas.

The mercury emission body carries mercury before filling into the container and after filled, it is able to emit mercury into the container. Various methods, for instance, a means to make an alloy of mercury with other metals, a method to adsorb mercury in other materials physically or chemically, or a method to contain mercury in a small container in a size that can be filled in the container are considered for carrying mercury. However, any method is usable provided that mercury can be contained in a desired container.

Regarding a time required for mercury collected to the cold spot formed at one end, it was confirmed by experiments conducted by the inventor that it relates to an amount of mercury filled in the container. Further, it was also revealed that a phenomenon that mercury collected to the cold spot moves to other portion from the cold spot by vibration, etc. will appear when an amount of filled mercury is much and that mercury scarcely moves in case of a lamp with an amount of mercury filled needed only for lighting and does not affect the lamp characteristic. In other words, a time for excess mercury in the container to be collected to the cold spot is delayed and mercury moves to other place from the cold spot.

According to the present invention, the cold spot is formed at one end and mercury is filled by the mercury emission body and therefore, almost no excess mercury exists in the container, luminous flux starts up fast, mercury collected to the cold spot scarcely moves to other portions, and the lamp characteristic is stabilized.

Further, the startup of luminous flux referred to here does not imply such a temporary rise of luminous flux that luminous flux once rises after lighting a lamp, mercury vapor pressure also rises continuously while exceeding the maximum efficacy with subsequent temperature rise and luminous flux drops but it indicates the stable startup of luminous flux in a short time.

Further, in the low-pressure mercury vapor discharge lamp of the present invention, the airtight container is characterized in that it is in a ring type.

According to the present invention, it is possible to improve lighting efficacy of a ring type fluorescent lamp that is used mainly in a house lighting device and stabilize the lamp characteristic at the time of startup.

Further, in the low-pressure mercury vapor discharge lamp, the mercury emission body is characterized in that it is arranged at one electrode side.

Although a method to arrange the mercury emission body is not specially restricted, such methods as to house it in a thin tube arranged at one electrode side, to fix it with such a member as glass, etc. are enumerated. When the mercury emission body is of heating and fusing type, it may be fixed at a desired point on the inner surface of the container by heating.

According to the present invention, it becomes possible to easily collect mercury to the cold spot formed at one end by utilizing the action of mercury adsorbing force of mercury left in the mercury emission body or the mercury emission body and thus, the startup of luminous flux becomes more fast and the lamp characteristic is stabilized more certainly.

Further, in the low-pressure mercury vapor discharge lamp of the present invention, the mercury emission body is characterized in that it is arranged at a point below one of the electrodes when the discharge lamp is mounted in a lighting device.

According to the present invention, the cold spot is formed at a point below the electrode where the mercury emission body is arranged at the time of horizontal lighting and therefore, it becomes possible to utilize the action of the mercury adsorbing force of the mercury emission body certainly when mercury is collected to the cold spot.

Further, the low-pressure mercury vapor discharge lamp of the present invention is characterized in that it is provided with a first and a second ring type containers which are mutually in different diameters and positioned in the concentric circle state on the same plane surface; a first and a second electrodes provided at one ends of the first and the second ring type containers; a bridge formed through a discharge space at a point away from the other ends of the first and the second ring type containers so that the electric discharge is taken place between the first and the second electrodes; a no discharge path formed area that is formed between the bridge and other ends of the ring type container; a mercury emission body filled in the ring type container so that it is arranged in this no discharge path formed area; and a base to cover a part of one end and the other end of the ring type container.

According to the present invention, it is possible to improve the lighting efficacy of a double ring type fluorescent lamp that is used mainly in a lighting device for house use and stabilize the lamp characteristic at the time of startup.

Further, the low-pressure mercury vapor discharge lamp of the present invention is characterized in that it is provided with a first and a second straight tubular containers that are provided parallel to each other, a first and a second electrodes provided at one end of these first and the second straight tubular containers, a bridge formed through a discharge space at a point away from the other ends of the first and the second straight tubular container so that an electric discharge is taken place between the first and the second electrodes, a no discharge path formed area that is formed between the bridge and the other end of the ring type container, a mercury emission body filled in the first or the second straight tubular container so as to be arranged in this no discharge path formed area, and a base to cover one end of a straight tubular container.

According to the present invention, it is possible to improve the lighting efficacy of a compact type fluorescent lamp that is used mainly for light devices for houses, facilities and shops and stabilize the lamp characteristic at the time of startup.

Further, in the low-pressure mercury vapor discharge lamp of the present invention, the mercury emission body is characterized in that it is a pellet shape alloy comprising mercury and at least one kind of a group of Bi, Zn, Sn, Pb, Ag, In, Cu and Sb.

According to the present invention, mercury can be filled in a container according to a relatively simple method. Further, depending on kind of alloy, mercury vapor pressure can be controlled to a desired characteristic.

Further, in the low-pressure mercury vapor discharge lamp of the present invention, the mercury emission body is characterized in that it is a porous pellet medium made of at least one kind out of a group comprising silica, alumina, titania, iron and glass, with mercury impregnated.

A porous medium that is an aggregated matter comprising electrolytic separated iron (Fe) that was obtained by immersing an iron electrode in mercury and hardened in a rod shape by applying the mechanical pressure is suited.

According to the present invention, mercury can be filled in a container according to a relatively simple method.

Further, in the low-pressure mercury vapor discharge lamp of the present invention, the mercury emission body is characterized in that its metallic substrate surface is coated with a titanium-mercury alloy.

For the mercury emission body referred to here, Commodity Name "GEMEDIS" made by SAES Getters Inc., etc. are usable. By arranging this mercury emission body around the electrodes, it is possible to emit mercury by such a means as high frequency induction heating.

According to the present invention, mercury can be filled in a container according to a relatively simple method.

Further, in the low-pressure mercury vapor discharge lamp of the present invention, the mercury emission body is characterized in that it is a capsule containing mercury in the readily emitting state.

According to the present invention, mercury can be filled in a container according to a relatively simple method.

Further, in the low-pressure mercury vapor discharge lamp of the present invention, the airtight container is characterized in that a fluorescent membrane is formed therein and lights at a inner wall load of lamp bulb 500 $W/m^2$ or above.

Already known various fluorescent materials are usable for the fluorescent membrane and for instance, halophosphate phosphor, three wavelength luminescence type rare earth metal phosphor, etc. are usable for fluorescent lamps for general use. In addition, needless to say, any fluorescent materials are usable according to use and grade of fluorescent lamps.

The definition of the inner wall load of lamp bulb is the lamp input electric power per surface area of the inner surface of a container opposing an electric discharge path and the inner surface of a container at the portion wherein no discharge path is formed is excluded.

According to the low-pressure mercury vapor discharge lamp of the present invention, it is possible to provide a high load type fluorescent lamp having the fast startup of luminous flux and the stabilized lamp characteristic.

Further, the low-pressure mercury vapor discharge lamp is characterized in that the length of the mercury diffusion route from the cold spot formed in the container to the end of the container most far away therefrom is more than 400 mm, an amount of filled mercury for each mercury diffusion route is less than 6 mg within the range of length of the mercury diffusion route 400–500 mm and when the length of the mercury diffusion route is more than 500 mm, the relationship of $M \leqq 2800/S$ is satisfied, where S is a surface area of the bulb ($cm^2$) and M is a filled amount of mercury for each mercury diffusion route (mg)

The reason for why a time is required for mercury to collect to the cold spot formed in the container relates to a filling amount of mercury was described in the above. Here, it is found that the upper limit value of this filling amount of mercury is depending on the length of the mercury diffusion route and the inner surface area of the container. In other words, the movement of mercury is a phenomenon of mercury vapor being diffused to a low vapor pressure area in the container. If the mercury diffusion route of a container is long, a time needed for excess mercury to move becomes long and therefore, an amount of mercury to be fill must be adjusted according to a length of the mercury diffusion route. Further, if a diameter of a container is small and its length is long, it is hard for mercury vapor to diffuse and therefore, an upper limit of a mercury filling amount in inverse proportion to an inner surface area calculated from a diameter and a length of a container is demanded.

When the startup stability characteristic was measured by the inventor by varying a filling amount of mercury of various low-pressure mercury vapor discharge lamps, it was confirmed that a numerical value obtained by dividing an coefficient of correction 2800 with an inner surface area S ($cm^2$) of a container can be stipulated for a mercury filling amount M (mg). However, there is an exception; that is, when the length of the mercury diffusion route is within a range of 400–500 mm, readiness of diffusion of mercury vapor is satisfactory at around the upper limit value of the mercury filling amount obtained from the relationship between the coefficient of correction and the inner surface area S; however, amount of mercury becomes rather excess against the capacity of a container and an adverse effect to the discharge with the movement of granulated mercury when the blackening is generated by excess mercury and vibration is applied is considered and therefore, it is necessary to stipulate a mercury filling amount to be below an absolute amount. It was confirmed by the tests that these defects would not be generated when a mercury filling amount is below 6 mg within the range of the length of the mercury diffusion route is 400–500 mm. Further, it was also confirmed that in case of the discharge lamps of which mercury diffusion route lengths are less than 400 mm, if mercury in amount (preferred 5 mg or less) less than that of liquid mercury filled through the mercury emission body, the startup stability characteristic is satisfied and the defects mentioned above also would not be generated.

Further, the mercury diffusion route means a route from one end to the other end of a container when the cold spot is formed at one end of a tubular container and means a route from the cold spot to a pair of ends (more than 2 ends according to a shape) of a tubular container when the cold spot is formed at the intermediate region, for instance, a non discharge path formed area of a tubular container. Accordingly, when the cold spot is formed at an intermediate region such as the no discharge path formed area of a tubular container, there are more than one mercury diffusion routes and an added value of values obtained for mercury diffusion routes is defined to be an upper limit value of the mercury filling amount. An inner surface area S in this case is also not that of the entire container but is calculated from a part of inner surface area of a container opposing each mercury diffusion route.

According to the present invention, it is possible to optimize amount of mercury filled in a low-pressure mercury vapor discharge lamp having a length of the mercury diffusion route more than 400 mm.

Further, a lighting system of the present invention comprises the low-pressure mercury vapor discharge lamp described in the above invention, a lighting system to stably light up this low-pressure mercury vapor discharge lamp, and a main body of the lighting system to house the low-pressure mercury vapor discharge lamp and the lighting system.

According to the present invention, it is able to provide a lighting system equipped with the low-pressure mercury vapor discharge lamp of the invention described above.

BEST MODE OF CARRYING OUT OF THE INVENTION

A preferred embodiment of the present invention will be described below referring to the attached drawings.

Figure 1:
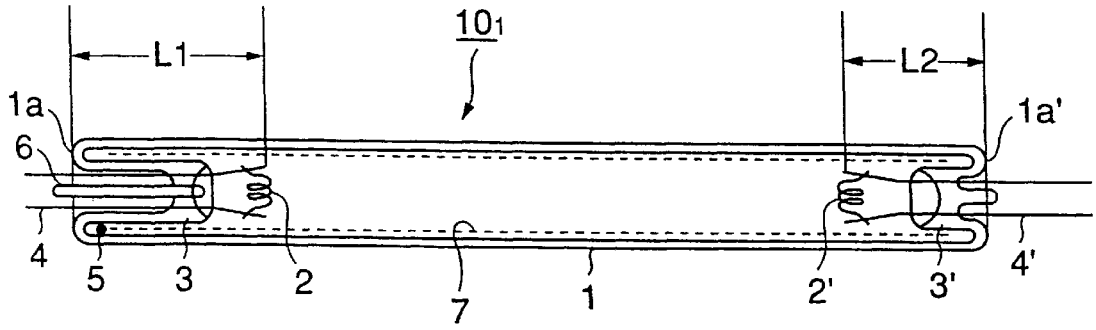
FIG. 1 is a schematic sectional view showing a fluorescent lamp in a first embodiment of the present invention.

FIG. 1 is a schematic sectional view showing a fluorescent lamp in a first embodiment of the present invention.

A fluorescent lamp $\mathbf{10}_1$ in this embodiment is applied with input power of 24 W exclusively for high frequency lighting type.

A translucent airtight container 1 is made of a soda glass made long and narrow straight tube in a diameter about 16 mm and 549 mm long.

A pair of electrodes 2 and 2' are of hot-cathode type with a coil filament coated with an emitter and separately arranged opposing each other in the airtight container 1. These electrode pair 2 and 2' are sealed at both ends of the bulb by a flare stem (described later) in the bulb 1. That is, they are sealed by sealing portions 1*a* and 1*a'* formed at both ends.

A pair of the electrodes 2 and 2' are so arranged that a length L1 from the sealing portion 1*a* of the electrode 2 becomes longer by about 15 mm than a length L2 from the sealing portion 1*a'* of the other electrode 2'. Further, L1 in this embodiment is about 35 mm and L2 is about 20 mm.

A pair of lead glass made flare stems 3 and 3' are sealed at both ends of the glass tube 1, comprising a part of the airtight container 1, supporting and sealing the electrodes 2 and 2' in the airtight container 1. Lead wires 4 and 4' are sealed to these stems 3 and 3' for supporting the electrodes 2 and 2'. These lead wires 4 and 4' are electrically connected from the outside to the lamp base pins (not shown) that are connected to the sealing portions 1*a* and 1*a'* of the airtight container 1.

A mercury discharging body 5 used in this embodiment is Zn—Hg amalgam made in a spherical shape pellet in diameter about 1 mm. The mercury discharging body 5 is arranged at the root of the stem 3 at the electrode 2 that has a longer distance from, the end of the tube 1. Further, the mercury discharging body 5 may be arranged in a thin tube 6 that is formed on the stem 3 instead of arranging at the root of the stem 3.

A fluorescent membrane 7 is formed on the inner surface of the tube 1. Further, the fluorescent membrane 7 may be formed on a protective membrane formed on the inner surface of the tube 1. Already known various fluorescent materials are usable for the fluorescent membrane 7 and for instance, halo-phosphate phosphor, rare earth metal phosphor, three wavelength luminous type rare earth metal phosphor, etc. are usable for fluorescent lamps for general lighting.

Next, the operation of this embodiment will be described. The fluorescent lamp $\mathbf{10}_1$ of this embodiment and a fluorescent lamp (a trial manufactured product) in the same structure except pure mercury filled without using the mercury emission body were lighted. The measured results were compared.

As a first measuring condition, a time required until the lamp characteristic (electric characteristic, total luminous flux) was stabilized after turning the fluorescent lamps on at the same atmospheric temperature was measured. A time required for the fluorescent lamp in this embodiment was 20 min, while the trial manufactured fluorescent lamp required 100–200 hours.

Thus, a time needed for stabilizing the lamp characteristic is clearly short on the fluorescent lamp in this embodiment and a time for stabilizing the trial manufactured fluorescent lamp is long and fluctuation of luminous flux that is output during the lamp is ON becomes large. This is estimated because a time was needed until mercury condensed at the cold spot and a desired mercury vapor pressure was not obtained because excess mercury existing in the trial manufactured fluorescent lamp was much and readily movable to other portions. Further, as the mercury discharging body in this embodiment is amalgam, some mercury adsorbing force is presented and it is considered that this may be affected by the fact that mercury tends to condense at the sealing portion 1*a* side where this amalgam is arranged.

Figure 2:
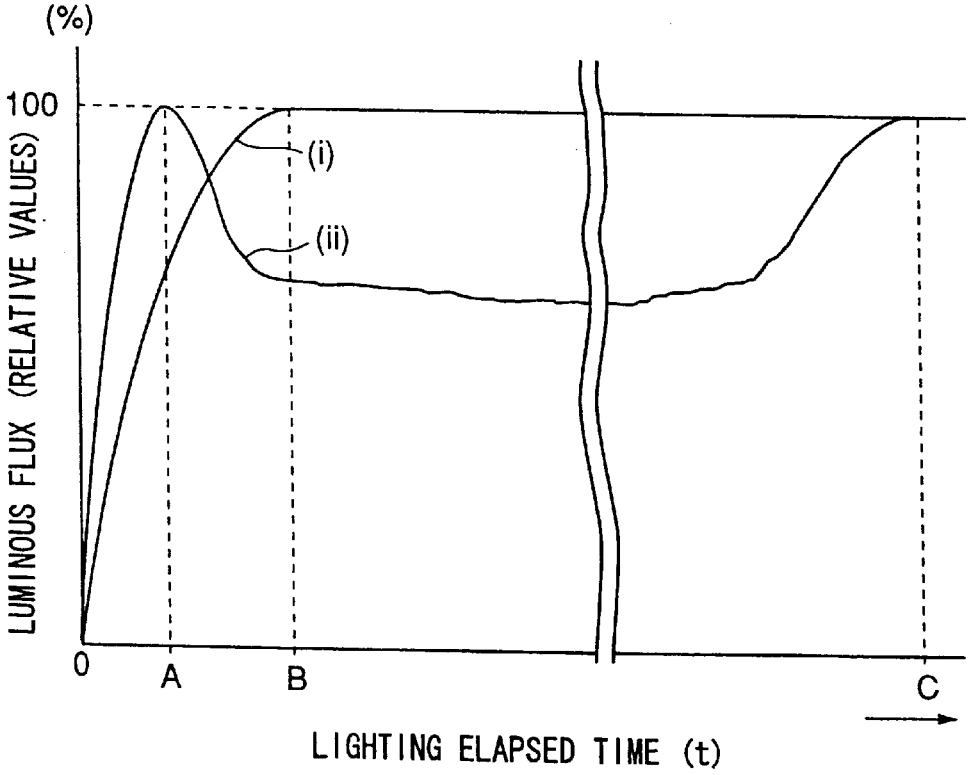
FIG. 2 is a graph showing the relationship between luminous flux and lighting elapsed time of the fluorescent lamp in the first embodiment.

FIG. 2 is a graph showing the result of the first measurement. Relative values of luminous flux are shown on the axis of ordinates and lighting elapsed time is shown on the axis of abscissas. In this graph, (i) shows the fluorescent lamp in the first embodiment and (ii) shows the trial manufactured fluorescent lamp with 20 mg of liquid mercury filled instead of pellet.

As can be seen from this graph, the trial manufactured fluorescent lamp once output the maximum luminous flux at the elapsed time A but the output dropped gradually and unstable output is continued for a while. This is because after the temperature in the tube rises when the lamp is turned on and reaches the optimum mercury vapor pressure (about 0.8 Pa), the temperature continuously rises by exceeding this optimum mercury vapor pressure. Thereafter, the cold spot is formed at a desired point in the tube and mercury begins to condense but because excess mercury is much, mercury vapor pressure becomes unstable until mercury condenses completely the cold spot and luminous flux also is not stabilized. Thereafter, the trial manufactured fluorescent lamp did not output light at the maximum luminous flux until the elapsed time C (several 100 hours) was reached.

On the contrary, in case of the fluorescent lamp in this embodiment, as the cold spot is formed in a space between the electrode 2 and the sealing portion 1*a*, the temperature rise is later than that of the trial manufacture lamp and the time B to reach the maximum luminous flux is slightly later than the time A. However, both of the elapse times A and B are an order of several ten seconds and almost not affect the practical use. In this embodiment, as L1 is set so that the cold spot becomes an optimum temperature (about 40° C.), the lamp lights at the maximum Luminous flux after the elapsed time B.

As the second measuring condition, luminous flux generating characteristics of the fluorescent lamp of this embodiment and the trial manufacture fluorescent lamp were evaluated. As a result, the fluorescent lamp in this embodiment was at a satisfactory level with almost no difference from the trial manufactured fluorescent lamp filled with pure silver and showed a remarkable improvement when compared with amalgams having relatively low mercury vapor pressure characteristic such as conventional Bi-In, etc.

Further, as the temperature at the cold spot is controllable by varying the height L1 of the electrode 2, it is possible to design total luminous flux of the fluorescent lamp so as to optimize it according to various characteristics of the fluorescent lamp.

In this embodiment, amalgam pellet was used as the mercury discharging body 5 but pellet of porous medium made of titanium or glass with mercury impregnated is also usable.

Further, a product of Commodity Name "GEMEDIS" with titanium-mercury alloy costed on the metallic base surface provided near the electrode as a sealed ring may be usable as a mercury discharging body.

Further, a thin tube 6 with a capsule containing mercury for discharging mercury from the capsule after sealing the tube 1 is also usable as a mercury discharging body.

Figure 3:
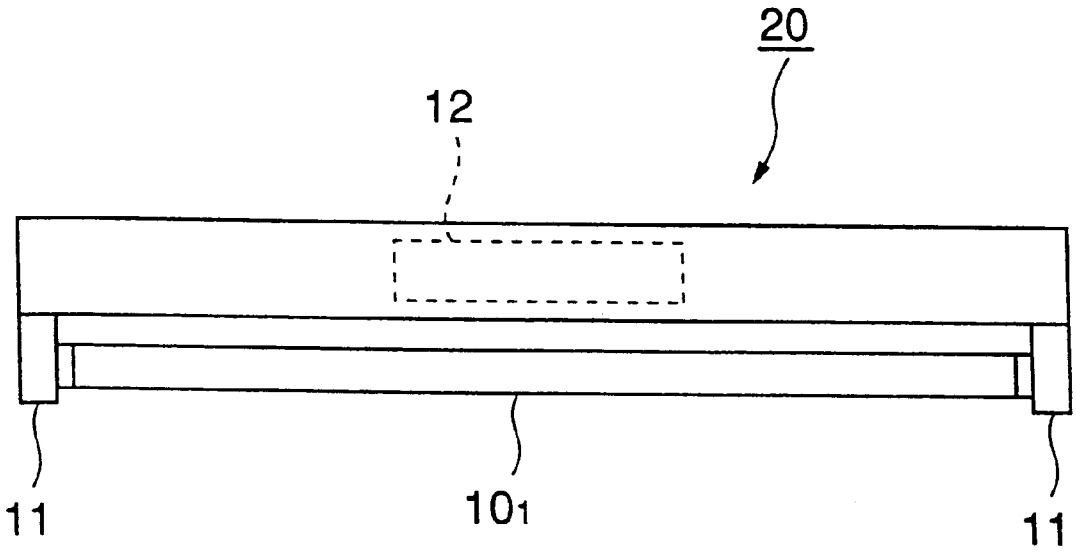
FIG. 3 is a schematic front view showing the state of the fluorescent lamp shown in FIG. 1 mounted in a lighting system

FIG. 3 is a schematic front view showing the state of the fluorescent lamp shown in FIG. 1 mounted in a lighting system. In this diagram, a lighting system main body 20 is provided with a pair of sockets 11 and 11 to support the fluorescent lamp $\mathbf{10}_1$ of the present invention and houses a lighting system 12 in the inside.

Figure 4:
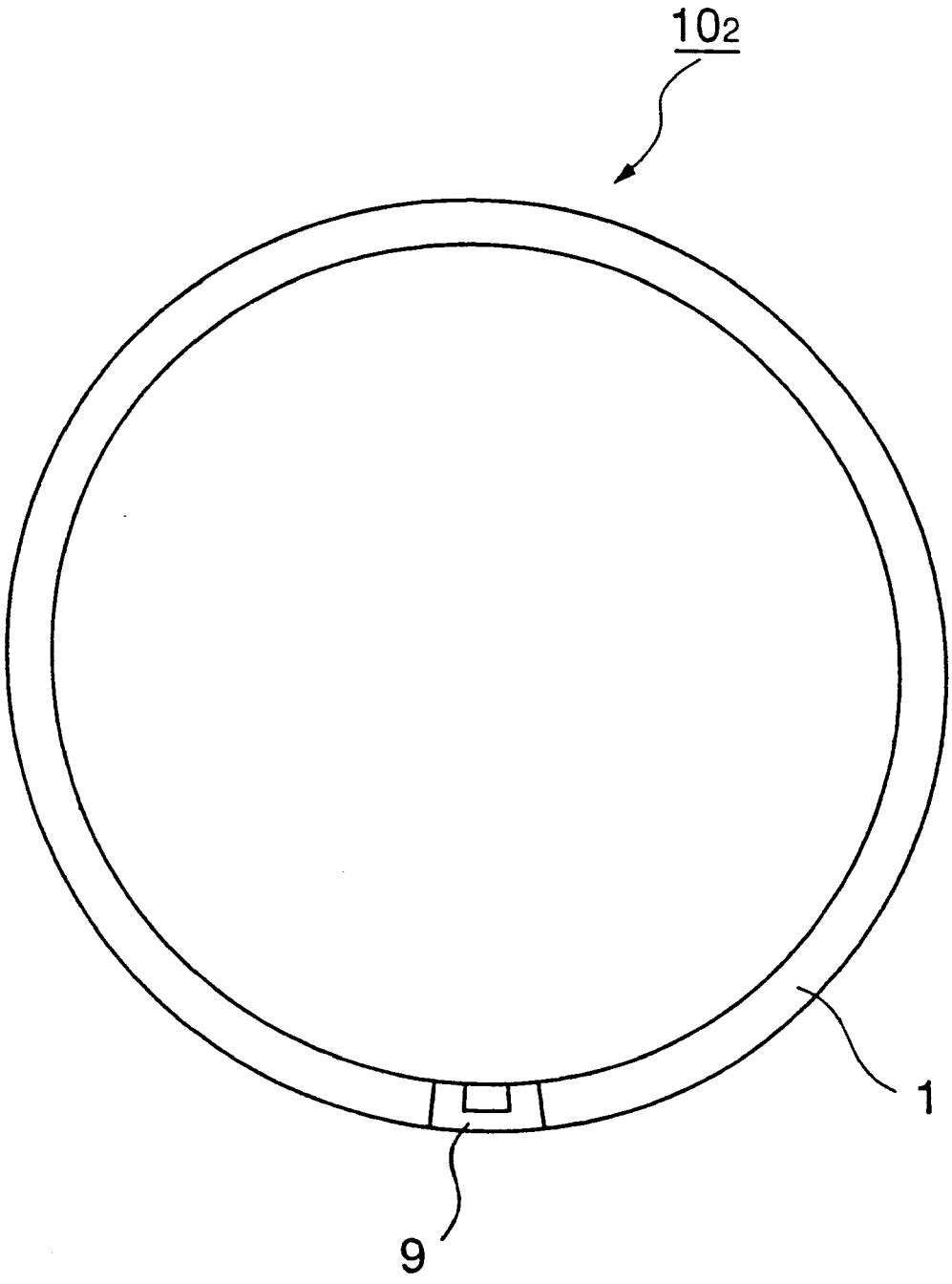
FIG. 4 is a plan view showing a ring type fluorescent lamp in a second embodiment of the present invention.
Figure 5:
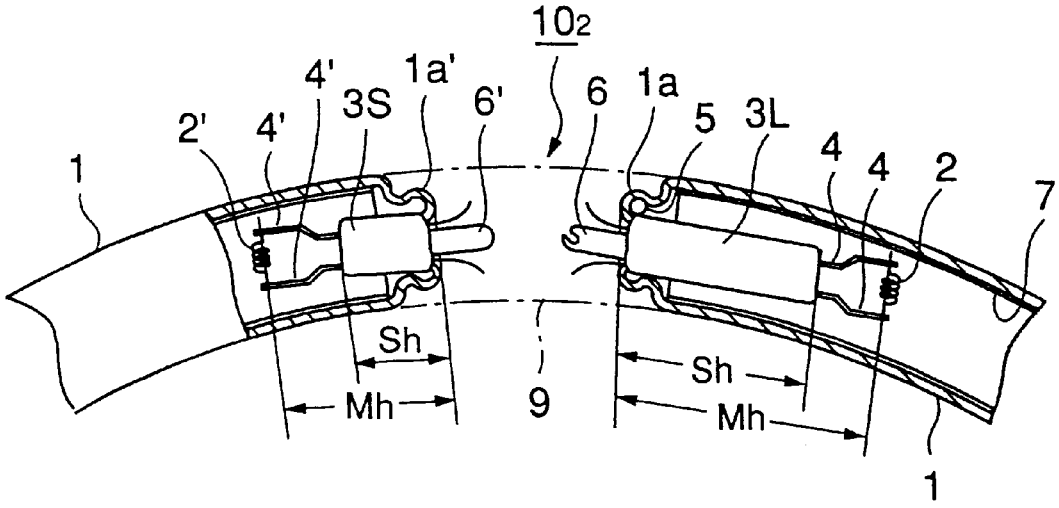
FIG. 5 is a sectional view showing the enlarged essential portion of the fluorescent lamp shown in FIG. 4.
Figure 6:
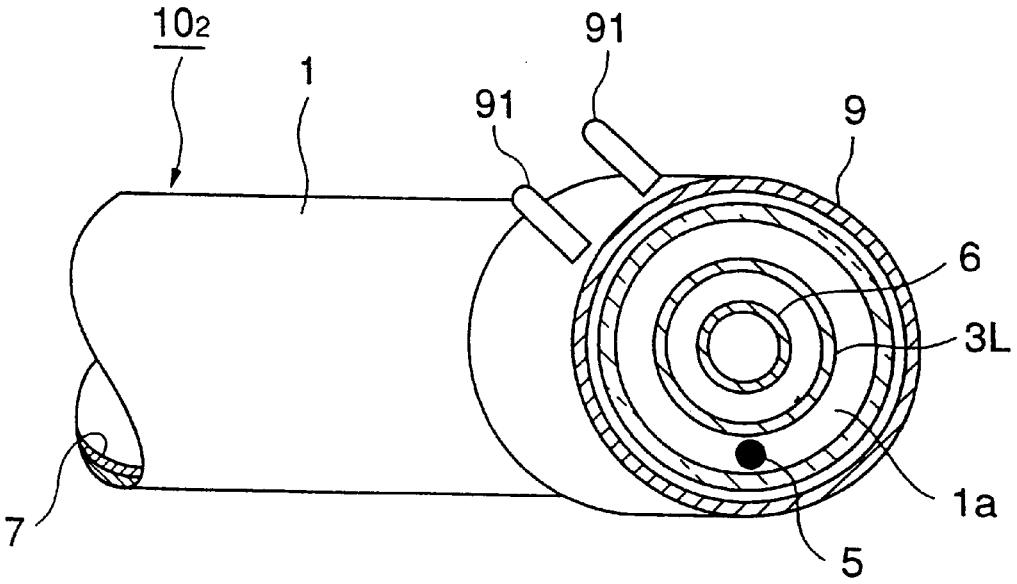
FIG. 6 is an enlarged sectional view of the essential portion showing the state of the fluorescent lamp shown in FIG. 4 mounted in the lighting system.

Next, a ring type fluorescent lamp in the second embodiment of the present invention will be described referring to FIG. 4 through FIG. 6. FIG. 4 is a plan view of a ring type fluorescent lamp, FIG. 5 is an enlarged sectional view of an essential portion of the fluorescent lamp shown in FIG. 4 and FIG. 6 is an enlarged section view of an essential portion showing the state of the fluorescent lamp shown in FIG. 4 mounted in a lighting device. Further, the ring type fluorescent lamp in this embodiment is shown by simplified for convenience and therefore, dimensional ratio in the diagram differs somewhat from an actual lamp. Further, the same reference numerals will be assigned to the same components as those in the first embodiment and the detailed explanation thereof will be omitted.

The airtight container 1 is a ring type tube made of soda lime glass. The airtight container 1 has an outer diameter in about 16.5 mm, thickness in about 1.1 mm, ring outer diameter in about 373 mm, and ring inner diameter in about 340 mm. Further, the ring type fluorescent lamp of this embodiment is of FHC type of a rated lamp power 34 W.

Lead glass made flare stems 3L and 3S are sealed in this airtight container 1 at both ends, respectively. These stems 3L and 3S have a stem tube in outer diameter about 8 mm and thickness about 1.0 mm at the intermediate portion except the sealed portion.

The stem 3L is sealed in the sealing portion 1*a* at one end side of the airtight container 1 and the stem 3S is sealed in the sealing portion 1*a* 'at the other end side.

A pair of lead wires 4 and 4' and lead glass made thin tube 6 and 6' in outer diameter about 5.5 mm and thickness about 0.9 mm are penetrating through the stems 3L and 3S and sealed at the points projecting about 5–10 mm to the outside of the airtight container 1. The thin tube 6 sealed in the stem 3L functions as an exhaust tube to make the exhaust after the airtight container 1 is bent.

A discharge electrode 2 composed of a coil filament is connected between ends of the lead wires 4, 4 and 4', 4' and the other ends of the lead wires 4, 4 and 4', 4' are lead to the outside of the airtight container 1.

The mercury emission body composed of amalgam pellet is fused and fixed between the sealing portion 1*a* at the stem 3L side and the node formed for chucking the airtight container when bending it. This mercury emission body 5 is a granulated zinc-mercury alloy in diameter about 1 mm, filled from the thin tube 6 after bending the airtight container 1, fused and fixed by blowing hot air from the outside of the sealing portion 1*a*. Further, amount of mercury discharged into the airtight container 1 from the mercury emission body 5 is about 6 mg. Further, the mercury emission body 5 in this embodiment is fixed but it is not necessarily fixed to get the stabilized characteristic of startup and can be filled movably in the airtight container 1. However, if the mercury emission body 5 was fixed in the airtight container 1, a sound generated by a vibration applied to the ring type fluorescent lamp during transportation and mounting can be suppressed and may not possibly damage the fluorescent membrane and the electrodes 2 and 2' that will be described later. Further, if the mercury emission body 5 is housed in the thin tube 6, the fixing process and control can be omitted. Further, for the heating required to fuse and fix the mercury emission body 5 or discharge mercury, it is possible to utilize heat left after heating the airtight container in the exhausting and bending process in addition to a method to brow hot air as described above.

The stems 3L and 3S have different lengths from the sealing portion 1*a* and 1*a*'. That is, the length Sh of the stem tube of the stem 3L is about 27 mm and the mount height Mh (a length from the sealing portion 1*a* to the electrode 2) is about 37 mm. Further, the length Sh' of the stem tube of the stem 3S is about 13 mm and the mount height Mh' is about 22 mm, and this stem 3S is in the same size of a conventional product.

On the inner surface of the airtight container 1, the fluorescent membrane 7 made of three band luminous type rare earth metal phosphor or continuous band luminous type halo-phosphate phosphor is formed. For instance, a protective membrane comprising alumina ($Al_2O_3$) fine grain is formed on the inner surface of the airtight container 1 and this fluorescent membrane 7 may be formed on this protective membrane. Mercury and such rare gas as argon (Ar), krypton (Kr), neon (Ne), xenon (Xe) are filled in the airtight container 1 independently or in mix as a discharge retaining medium. In this embodiment, 100% of argon (Ar) is filled in the airtight container 1 at the pressure about 2.5 Torr.

A base 9 is mounted between the sealing portions la and 1*a*' by bridging them at both ends of the airtight container 1. Four terminal pins 91 electrically connected to the electrode are projected from this base 9 inclined to the central side of the airtight container 1. The spaces between of the vertical and lateral points of these four terminal pins 91 are about 6 mm and 10 mm, differing from the sizes of pin spaces of a conventional standardized base so that conventional sockets are not mounted to the base 9, thus preventing their erroneous insertion.

The ring type fluorescent lamp $10_2$ is mounted and supported on a lamp holder (not shown) of a lighting device and the socket is inserted into the terminal pins 91, supplied with electric power via a high frequency lighting circuit, causing discharge and lights up the lamp.

Next, the operation in this embodiment will be described. On the ring type fluorescent lamp $10_2$, the luminescence is continued by the discharge taken place between the electrodes 2 and 2' and the temperature of the airtight container 1 rises. The point where a temperature becomes most high by this lighting is near the electrodes 2 and 2'. Further, the most low temperature point is the sealing portion 1*a* that is formed in a ring shape by the node at the stem 3L side, and this point at the most low temperature becomes the cold spot.

As shown in FIG. 6, it is seen that in the state wherein the ring type fluorescent lamp $10_2$ is mounted horizontally in a lighting device (not shown), the mercury emission body 5 is fixed at a position below the sealing portion 1*a*. When the ring type fluorescent lamp $10_2$ lights horizontally, the cold spot is formed at a point below the sealing portion 1*a* where the mercury emission body 5 is fixed and therefore, it becomes possible to collect mercury effectively by utilizing the action of the mercury adsorbing force of the mercury emission body 5 when mercury is collected to the cold spot.

In this embodiment, the mercury emission body 5 was fixed at a point below the sealing portion 1*a* because the cold spot is formed below the sealing portion 1*a*. However, when the cold spot is formed in the thin tube 6, it is desirable to fix the mercury emission body 5 in the thin tube 6.

In case of a conventional ring type fluorescent lamp of 29 mm in tube outer diameter, the cold spot is formed at the central part of an airtight container that is most away from a pair of electrodes in many cases. In case of the ring type fluorescent lamp in this embodiment, the inner diameter of its tube is as thin as 20 mm or below and its inner wall load of the lamp bulb (input power per surface area in the tube) is as large as above 500 $W/m^2$ and therefore, the temperature becomes low at the sealing portion 1*a* at the stem 3L side having a larger mount height Mh than the central portion of the airtight container, that is the middle of the discharge path and the cold spot is formed here. In particular, the cold spot formed at the stem 3L side has a merit that it is hardly affected by the discharging heat as it is away by more than 30 mm from the electrode 2 and the discharge path, and it is possible to keep the cold spot at a relatively proper temperature even when housed in a lighting device with a shade and a temperature in the device is high. Accordingly, by bring the mercury vapor pressure close to an optimum value, it is possible to suppress the drop of luminous output and improve luminous efficacy even when the lamp is kept lighted continuously in the state of a high ambient temperature.

According to the experiments conducted by this inventor, etc., it was confirmed that above mentioned effect is presented when the mount height of the stem 3L is made to 30–50 mm and the stem tube height Sh to 20–40 mm on the ring type fluorescent lamp $10_2$ of which outer diameter of the airtight container 1 was made as thin as 14–18 mm (thickness in 0.8–1.3 mm). When the mount height Mh of the stem 3L is less than 30 mm, the thin tube 6 or the sealing portion 1*a* is affected by the heat generated from the discharge and does not act as the cold spot.

Further, when the mount height is above 50 mm, the electrode portion comes close to the wall of the curved airtight container 1 and damages the fluorescent membrane or the shadow of the electrode portion is reflected on the airtight container which are not desirable and a good result was shown at the mount height 35–45 mm which varies depending on kind of fluorescent lamp.

Further, regarding the stem tube height Sh of the stem of 3L, 20–40 mm is desirable from the manufacturing point of view and when considering the effect of heat from the discharge.

When the mount height Mh of the stem 3L of the ring type fluorescent lamp $10_2$ in this embodiment was made to 37 mm, the mount height Mh' of the stem 3S was made to 23 mm, the lamp was turned ON at a lamp voltage 125V, lamp current 380 mA and lamp power 48 W and the initial luminous flux was measured in the atmosphere at ambient temperature 35° C. when 100 hours were elapsed after the lamp was turned ON, it was confirmed that the lamp lighted at high efficiency of total luminous flux 4250 lm and 86.8 lm/W. On the other hand, when the initial luminous flux was measured at an ambient temperature 35° C. at the same lamp power with both mount heights Mh and Mh' of the stems 3L and 3S made at 23 mm, the lamp efficacy dropped by about 5% and it is therefore seen that the lighting efficacy of the ring type fluorescent lamp $10_2$ in this embodiment was improved particularly in a high temperature atmosphere.

Further, when the ring type fluorescent lamp $10_2$ in this embodiment horizontally lights, the cold spot is formed at the sealing portion 1*a*, mercury in the airtight container 1 is collected quickly to the cold spot through diffusion of mercury vapor, luminous flux starts up rapidly and the lamp characteristic is stabilized. An amount of mercury filled in the airtight container after collected at the cold spot is as small as about 6 mg and therefore, there is no phenomenon that mercury is moved to other portion from the cold spot by a vibration, etc.

Further, because the cold spot is formed at the position below the sealing portion 1*a* where the mercury emission body 5 is fixed, mercury can be collected effectively utilizing the action of the mercury adsorbing force of the mercury emission body 5 when mercury is collected at the cold spot.

Figure 7:
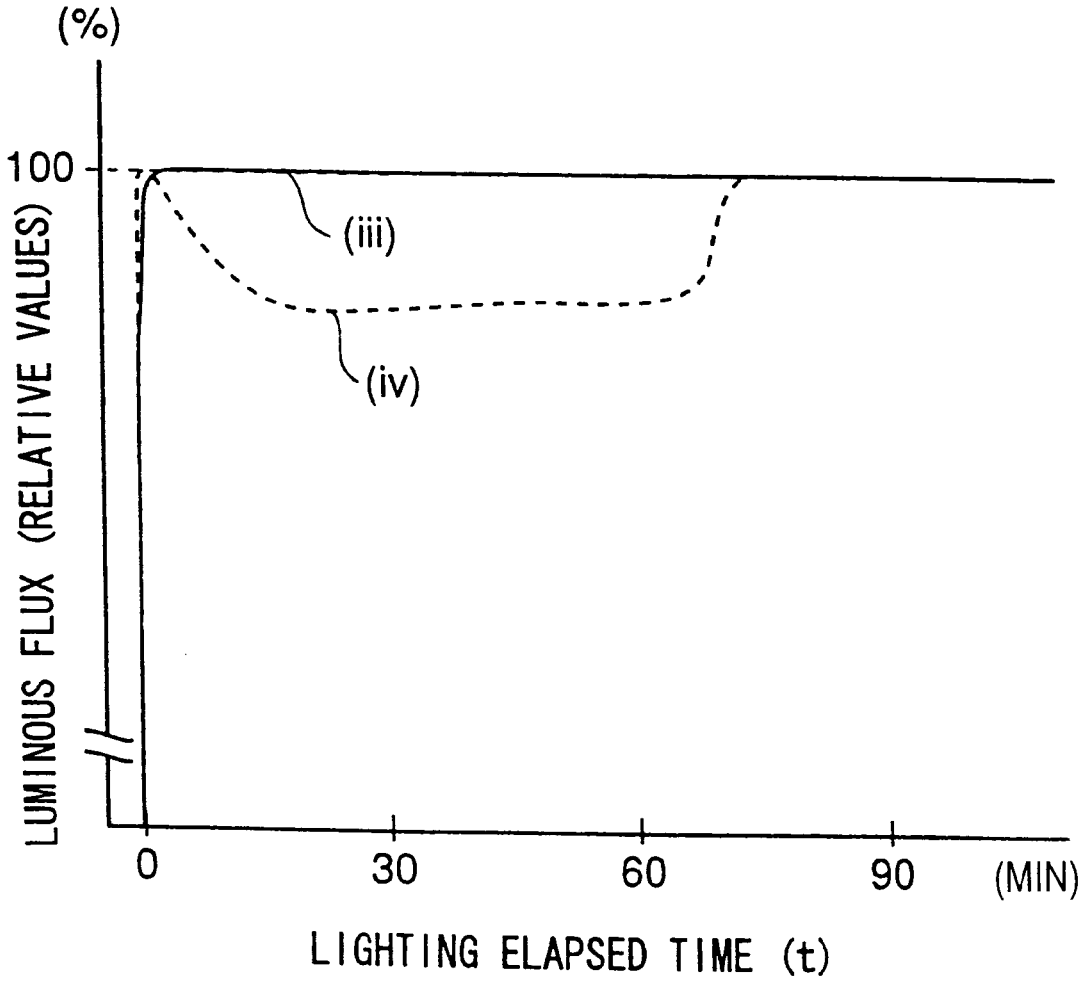
FIG. 7 is a graph showing the relationship between luminous flux and lighting elapsed time of the ring type fluorescent lamp in the second embodiment.

FIG. 7 is a graph showing the result of the second measurement, and relative values of luminous flux are shown on the axis of ordinates and the lighting elapsed times are shown on the axis of abscissas. In this diagram, (iii) shown by the solid line is the ring type fluorescent lamp in the second embodiment and (iv) shown by the broken line is a ring type fluorescent lamp used as an example for comparison. The ring type fluorescent lamp of the comparison example is in the same structure as the ring type fluorescent lamp in the second embodiment except that 20 mg of liquid pure mercury is filled instead of a mercury emission body.

As can be seen from the graph shown in FIG. 7, the ring type fluorescent lamp of the second embodiment reached 100% of the relative luminous flux value and was saturated in about 3 minutes after started to light, while the ring type fluorescent lamp of the comparison example reached 100% of the relative luminous flux value within 3 minutes after started to light but thereafter, the luminous flux dropped by about 8.5% and the unstable output was continued for a certain time. Then, when about 80 minutes was elapsed after started to light, 100% of relative luminous flux value was reached again.

It is considered that the luminous flux of the ring type fluorescent lamp for comparison becomes unstable because the cold spot is formed at the sealing portion 1*a* in the airtight container and mercury begins to be collected thereto but vapor pressure becomes unstable until it is condensed fully at the cold spot as there is much excess mercury.

Next, a double ring type fluorescent lamp and a compact type fluorescent lamp in the third and fourth embodiments will be described referring to FIG. 8 and FIG. 9. The same component elements as those in the first and second embodiments will be assigned with the same reference numerals and the explanations thereof will be omitted.

Figure 8:
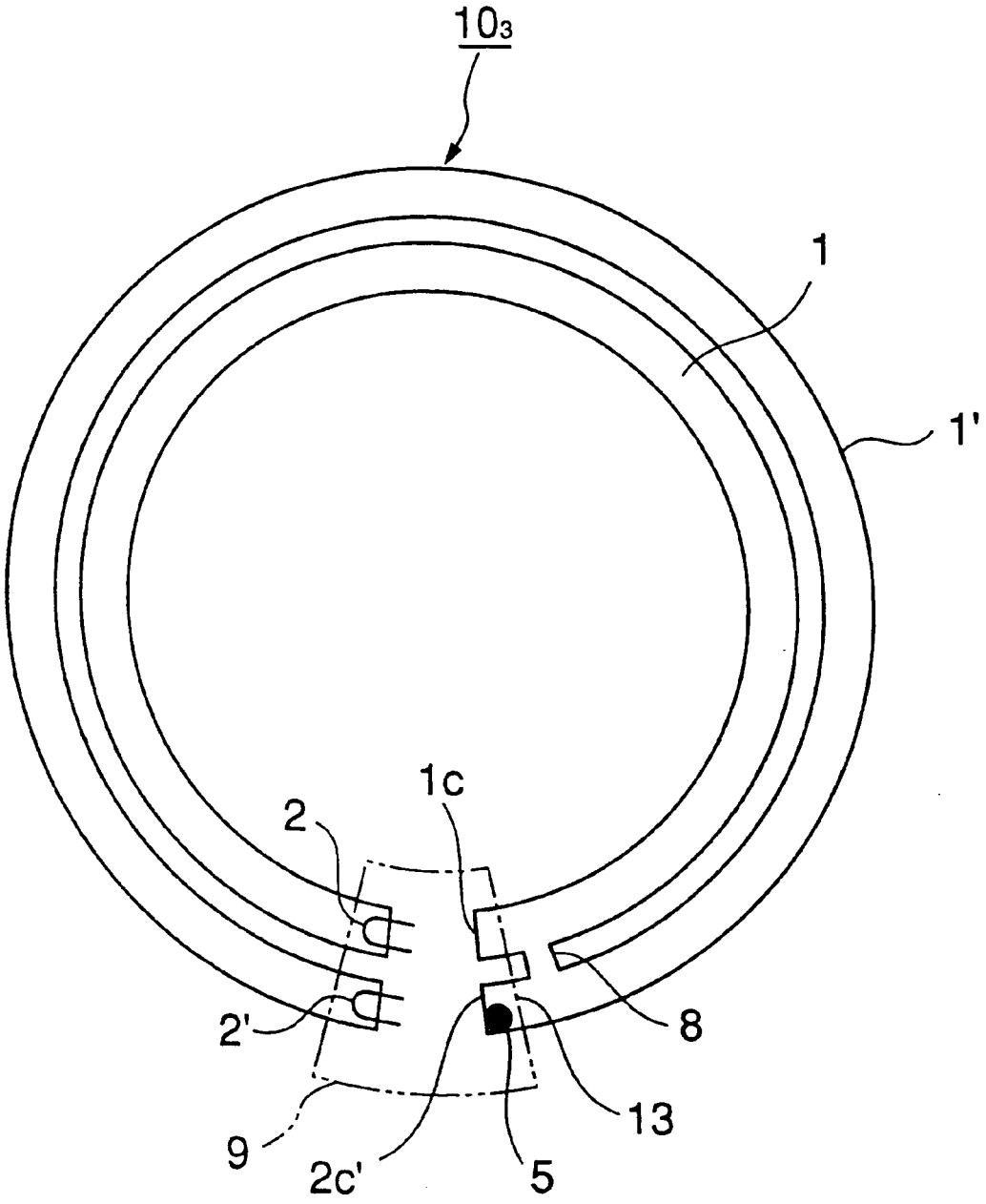
FIG. 8 is a schematic plan view of double ring type fluorescent lamps in a third embodiment of the present invention.

FIG. 8 is a schematic plan view of the double ring type fluorescent lamp in the third embodiment.

The double ring type fluorescent lamp $\mathbf{10}_3$ is provided with airtight containers 1 and 1' as first and second ring type tubes, which are in different diameter each other. These airtight containers 1 and 1' are positioned in the shape of concentric circle on the same plane surface and connected by a bridge 8. Further, the inner diameter of these airtight containers 1 and 1' is about 18 mm and the outer diameters are 334 mm and 400 mm, respectively.

At one end side of these airtight containers 1 and 1', the first and second electrodes 2 and 2' are arranged. The bridge 8 is formed at the point 18–26 mm away from the other ends 1*c* and 1*c'* of the airtight containers 1 and 1' so as to produce a discharge space to cause the discharge between the electrodes 2 and 2'.

Between the bridge 8 and the other ends 1*c* and 1*c'* of the airtight containers 1 and 1', there is a no-discharge path formed area 13 wherein no discharge path is formed and this no-discharge path formed area 13 becomes the cold spot.

On the inner surface of the airtight container 1' in the no-discharge path formed area 13, the granulated mercury emission body 5 comprising a zinc-mercury alloy of 1 mm in diameter is fixed likewise the second embodiment.

The base 9 is installed over one ends and the other ends 1*c* and 1*c'* of the airtight container 1 and 1'. Further, the base 9 is installed on the airtight containers 1 and 1' so as not to cover the bridge 8 and a part of the no-discharge path formed area 13.

In case of the double ring type fluorescent lamp $\mathbf{10}_3$ in the third embodiment, the cold spot is formed in the no-discharge path formed area 13 with the lighting of the fluorescent lamp likewise the above-mentioned embodiments, mercury in the airtight containers 1 and 1' is quickly collected to the cold spot by diffusion of mercury vapor, luminous flux starts up fast and the lamp characteristic is stabilized. As an amount of mercury in the airtight containers is as small as about 6 mg, the mercury collected at the cold spot is not moved to other portion by a vibration, etc. In this case, the mercury diffusion route is formed from the end 1*c*', where the mercury emission body 5 is fixed, to the electrodes 2 and 2', respectively and therefore, the amount of mercury filled is below the upper limit value that is an added value of upper limit values specified for each of these two mercury diffusion routes. In case of this embodiment, an upper limit value of the filled amount of mercury for each mercury diffusion route, when computed, is 4.5 mg and therefore, the upper limit value of filled amount of mercury of the whole mercury diffusion route becomes 9 mg.

Further, as the cold spot is formed in the no-discharge path formed area 13 wherein the mercury emission body 5 is fixed, it is possible to collect mercury effectively utilizing the action of mercury adsorbing force of the mercury emission body 5 when mercury is collected to the cold spot.

Further, when the cold spot is formed in thin tubes (not shown) formed at the other ends 1*c* and 1*c*, it is desirable to arrange the mercury emission body 5 in the thin tube. However, if the lamp characteristic is stable, the mercury emission body 5 may be filled in the airtight containers 1 and 1' in the movable state.

Figure 9:
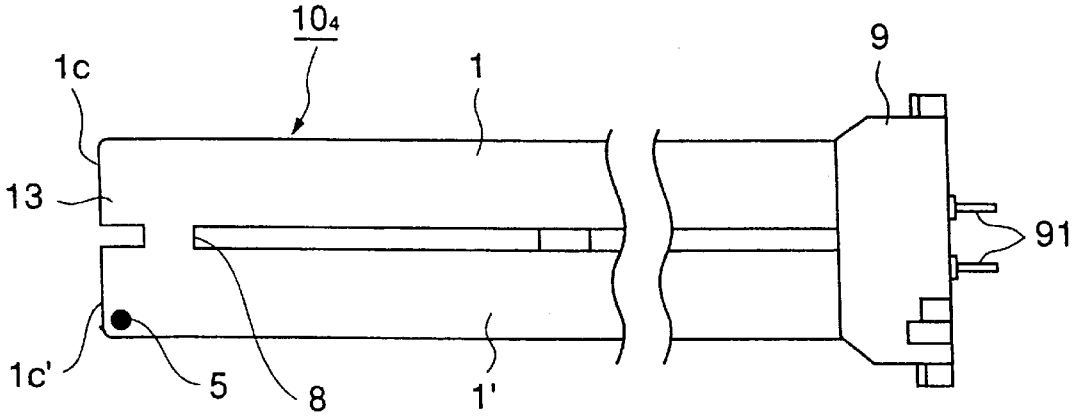
FIG. 9 is a schematic plan view of a compact type fluorescent lamp in a fourth embodiment of the present invention.

FIG. 9 is a schematic plan view of the compact type fluorescent lamp in the fourth embodiment.

The compact type fluorescent lamp $10_4$ has the airtight containers 1 and 1' as parallel straight tubes. These airtight containers 1 and 1' are connected each other by the bridge 8. Further, the inner diameter of these airtight containers 1 and 1' is about 15 mm and the tube length is about 1,150 mm, respectively.

At one end of these airtight containers 1 and 1', first and second electrodes (not shown) are arranged. The bridge 8 is formed at the point 30 mm away from the other ends 1*c* and 1*c*' of the airtight containers 1 and 1' so as to produce a discharge space for causing the discharge.

Between the bridge 8 and the other ends 1*c* and 1*c*' of the airtight containers 1 and 1', there is a no-discharge path formed area 13 wherein no discharge path is formed and the no-discharge path formed area 13 becomes the cold spot.

On the inner surface of the airtight container 1' in the no-discharge path formed area 13, the granulated mercury emission body 5 comprising a zinc-mercury alloy of about 1 mm in diameter is fixed likewise the second embodiment.

The base 9 is mounted on one end side of the airtight containers 1 and 1'.

In case of the compact type fluorescent lamp $10_4$ in the fourth embodiment, the cold spot is formed in the no-discharge path formed area 13 and with the lighting of the fluorescent lamp, mercury in the airtight containers 1 and 1' is quickly collected to the cold spot by diffusion of mercury vapor, luminous flux is fast generated and the lamp characteristic is stabilized likewise the embodiments described above. As an amount of mercury in the airtight containers is as small as about 6 mg, there is no phenomenon that the mercury collected at the cold spot is not moved to other portion by vibration, etc.

Further, as the cold spot is formed in the no-discharge path formed area 13 wherein the mercury emission body 5 is fixed, it is possible to collect mercury effective by utilizing the action of the mercury adsorbing force of the mercury emission body 5 when mercury is collected to the cold spot.

Further, when the cold spot is formed in thin tubes (not shown) formed at the other ends 1*c* and 1*c*', it is desirable to arrange the mercury emission body 5 in the thin tube. However, if the lamp characteristic is stable, the mercury emission body 5 may be filled movable in the airtight containers 1 and 1'.

According to the present invention, the cold spot is formed at one end of a fluorescent lamp and mercury is filled in an airtight container by a mercury emission body and therefore, there is almost no excess mercury in the airtight container, luminous flux starts up fast, mercury collected in the cold spot scarcely moves to other portions and the lamp characteristic is stabilized.

Further, the startup of luminous flux referred to here does not mean a temporary rise of luminous flux that drops after once rising with start-up lighting and continuous mercury vapor pressure rise exceeding the maximum efficacy with subsequent temperature rise but indicates the startup of stabilized luminous flux in a short time.

What is claimed is:

1. A low-pressure mercury vapor discharge lamp comprising:

a translucent airtight container;

a first electrode mounted in a first end of the airtight container, and a second electrode mounted in a second end of the airtight container, the first and second electrodes are arranged so that a distance between the first electrode and the first end is longer than a distance between the second electrode and the second end;

a mercury emission body filled in the airtight container;

discharge medium including mercury discharged from m the mercury emission body and inert gas, and a fluorescent membrane formed on an inner wall of the airtight container so as to illuminate the inner wall with a lamp bulb load of 500 w/m$^2$ or above.

2. A low-pressure mercury vapor discharge lamp comprising:

a translucent airtight container;

a first electrode mounted in a first end of the airtight container, and a second electrode mounted in a second end of the airtight container, the first and second electrodes are arranged so that a first distance between the first electrode and the first end is longer than a second distance between the second electrode and the second end;

a mercury emission body filled in the airtight container; and discharge medium including mercury discharged from the mercury emission body and inert gas, wherein the airtight container having a cold spot, a mercury diffusion route having a length greater than 400 mm defined between the cold spot and the end of the container farthest away from the cold spot, and an amount of mercury filled in the mercury diffusion route according to the following conditions:

when the length of the mercury diffusion route is in the range of 400–500 mm, the amount of mercury filled is less than 6 mg ; and when the length of the mercury diffusion route is greater than 500 mm, the amount of mercury filled is determined by the relationship:

$$M \leqq 2800/S$$

where S (cm$^2$) is a surface area inside a tube having the length of the mercury diffusion route greater than 500 mm and M (mg) is the amount of filled mercury for every mercury diffusion route.

3. A low-pressure mercury vapor discharge lamp according to claim 1 or 2, wherein the airtight container is a ring type.

4. A low-pressure mercury vapor discharge lamp according to claim 1 or 2, wherein the mercury emission body is arranged at one of the electrode sides.

5. A low-pressure mercury vapor discharge lamp according to claim 1 or 2, wherein the mercury emission body is arranged at the position below one of the electrode side when a discharge lamp is mounted in a lighting device in a horizontal state.

6. A low-pressure mercury vapor discharge lamp comprising:

first and second ring type tubes having different diameters and positioned in a concentric circle shape on the same plane surface;

first and second electrodes provided at a respective first end of the first and the second ring type tubes:

a bridge between the first and second ring type tubes forming a discharge space at a position away from the respective second ends of the first and the second ring type tubes so as to produce a discharge route between the first and the second electrodes;

a no-discharge path area formed between the bridge and the second ends of the ring type tubes:

a mercury emission body filled is a ring type tube so as to be arranged in the no-discharge path area; and a base to cover a part of the no-discharge path area of the second ends and the first ends of the ring type tubes, wherein n a fluorescent membrane is formed on an inner wall of the airtight container so as to illuminate the inner wall with a lamp bulb load of 500 $W/m^2$ or greater.

7. A low-pressure mercury vapor discharge lamp comprising:

first and second ring type tubes having different diameters and positioned in a concentric circle shape on the same plane surface;

first and second electrodes provided at a respective first end of the first and the second ring type tubes:

a bridge between the first and second ring type tubes forming a discharge space at a position away from the respective second ends of the first and the second ring type tubes so as to produce a discharge route between the first and the second electrodes;

a no-discharge path area formed between the bridge and the second ends of the ring type tubes:

a mercury emission body disposed in a ring type tube so as to be arranged in the no-discharge path area; and a base to cover a part of the no-discharge path area of the second ends and the first ends of the ring type tubes, wherein the airtight container having a cold spot, a mercury diffusion route having a length greater than 400 mm defined between the cold spot and the end of the container farthest away from the cold spot, and an amount of mercury filled in the mercury diffusion route according to the following conditions:

when the length of the mercury diffusion route is in the range of 400–500 mm, the amount of mercury filled is less than 6 mg; and when the length of the mercury diffusion route is greater than 500 mm, the amount of mercury filled is determined by the relationship:

$$M \leqq 2800/S$$

where S ($cm^2$) is a surface area inside a tube having the length of the mercury diffusion route greater than 500 mm and M (mg) is the amount of filled mercury for every mercury diffusion route.

8. A low-pressure mercury vapor discharge lamp comprising:

first and second straight tubes;

a first electrode formed at a first end of the first straight tube and a second electrode formed at a first end of the second straight tube;

a bridge between the first and second tubes forming a discharge space at a position away from the respective second ends of the first and the second straight tubes so as to produce the discharge route between the first and the second electrodes;

a no-discharge path area formed between the bridge and the each second end of the first and second straight tubes;

a mercury emission body disposed in the no-discharge path area of one of the first and the second straight tubes; and a base to cover the first ends of the straight tubes, wherein a fluorescent membrane is formed on an inner wall of the airtight container so as to illuminate the inner wall with lamp bulb load of 500 $W/m^2$ or greater.

9. A low-pressure mercury vapor discharge lamp comprising:

first and second straight tubes;

a first electrode formed at a first end of the first straight tube and a second electrode formed at a first end of the second straight tube;

a bridge between the first and second tubes forming a discharge space at a position away from the respective second ends of the first and the second straight tubes so as to produce the discharge route between the first and the second electrodes;

a no-discharge path area formed between the bridge and the each second end of the first and second straight tubes;

a mercury emission body disposed in the no-discharge path area of one of the first and the second straight tubes; and a base to cover the first ends of the straight tubes, wherein the airtight container having a cold spot, a mercury diffusion route having a length greater than 400 mm defined between the cold spot and the end of the container farthest away from the cold spot, and an amount of mercury filled in the mercury diffusion route according to the following conditions:

when the length of the mercury diffusion route is in the range of 400–500 mm, the amount of mercury filled is less than 6 mg; and when the length of the mercury diffusion route is greater than 500 mm, the amount of mercury filled is determined by the relationship:

$$M \leqq 2800/S$$

where S ($cm^2$) is a surface area inside a tube having the length of the mercury diffusion route greater than 500 mm and M (mg) is the amount of filled mercury for every mercury diffusion route.

10. A low-pressure mercury vapor discharge lamp according to one of claims 1, 2, 6, 7, 8 and 9, wherein the mercury emission body is a pellet shape alloy comprising mercury and at least one kind out of a group comprising Bi, Zn, Sn, Pb, Ag, In, Cu and Sb.

11. A low-pressure mercury vapor discharge lamp according to one of claims 1, 2, 6, 7, 8 and 9, wherein the mercury emission body is a pellet of porous medium impregnated with mercury, and the pellet of porous medium principally comprising at least one kind out of a group of comprising silica, alumina, titania, iron and glass.

12. A low-pressure mercury vapor discharge lamp according to one of claims 1, 2, 6, 7, 8 and 9, wherein the mercury emission body is coated with a titanium-mercury alloy on the metallic base surface.

13. A low-pressure mercury vapor discharge lamp according to one of claims 1, 2, 6, 7, 8 and 9, wherein the mercury emission body is a capsule containing mercury inside so as to be able to discharge.

14. In a lighting system using the low-pressure mercury vapor discharge lamp according to one of claims 1, 2, 6, 7, 8 and 9, the lighting system comprising:

a lighting device to light the low-pressure mercury vapor discharge lamp stably; and a main body accommodating the low-pressure mercury vapor discharge lamp and the lighting device.

* * * * *